US009839995B2

(12) United States Patent
Kovach

(10) Patent No.: US 9,839,995 B2
(45) Date of Patent: Dec. 12, 2017

(54) DRAIN REMOVAL TOOL

(71) Applicant: Superior Tool Corp., Cleveland, OH (US)

(72) Inventor: James A. Kovach, Parma, OH (US)

(73) Assignee: MAGNA INDUSTRIES, INC., Cleveland, OH (US)

( * ) Notice: Subject to any disclaimer, the term of this patent is extended or adjusted under 35 U.S.C. 154(b) by 0 days.

(21) Appl. No.: 13/627,773

(22) Filed: Sep. 26, 2012

(65) Prior Publication Data

US 2013/0255452 A1 Oct. 3, 2013

Related U.S. Application Data

(60) Provisional application No. 61/539,095, filed on Sep. 26, 2011.

(51) Int. Cl.
*B25B 13/50* (2006.01)
*B25B 13/48* (2006.01)

(52) U.S. Cl.
CPC ..... *B25B 13/5083* (2013.01); *B25B 13/48* (2013.01)

(58) Field of Classification Search
CPC ... B25B 13/5083; B25B 13/48; B25B 13/481; B25B 13/5008; B25B 13/50; B25B 13/54; B25B 23/108; B25B 27/18; B25B 27/143; B25B 27/0028; B25B 27/0092
USPC ..... 81/436–461, 121.1, 3.45, 177.5, 53.2; 408/223–225
See application file for complete search history.

(56) References Cited

U.S. PATENT DOCUMENTS 1,687,727 A * 10/1928 Judge ..... B25B 13/48 81/436
1,746,825 A * 2/1930 Fabel ..... 81/441
1,863,046 A * 6/1932 Githens et al. ..... 81/441
2,518,116 A * 8/1950 Bete ..... 239/501
2,544,304 A * 3/1951 Eckenbeck ..... F16B 37/06 29/525
3,996,819 A * 12/1976 King ..... 81/124.6
4,237,754 A 12/1980 Battrick
4,446,765 A * 5/1984 Wheeler ..... 81/441
5,031,487 A * 7/1991 Polonsky ..... 81/53.2
5,251,516 A * 10/1993 Desaulniers ..... 81/53.2
(Continued)

OTHER PUBLICATIONS

Superior Tool Corp., Product Catalog, P.O. Plug Wrench, 2007.
(Continued)

*Primary Examiner* — Hadi Shakeri

(57) ABSTRACT

A drain removal tool with a central opening aligned along a central tool axis, a holding section with a hex head for applying torque to the tool, and an engagement section including elongate sharp ridges or teeth extending in a helical pattern from an external surface of the engagement section from the tool for engagement with the drain to be removed. Each elongate sharp ridge has one flat face and a ramp face. Each flat face is aligned along a radius extending outwardly from the central tool axis. The ridges are spaced such that the distance between each flat face is approximately 6 degrees. Each helical ridge is a left hand helical serration on a 15 degree pitch with respect to the central axis of the central opening. The holding section includes a hex head configuration. The central opening in the holding section has a hex configuration.

17 Claims, 3 Drawing Sheets

(56) References Cited

U.S. PATENT DOCUMENTS

| | | | | |
|---|---|---|---|---|
| 5,737,981 | A * | 4/1998 | Hildebrand | B25B 27/18 81/120 |
| 6,070,505 | A * | 6/2000 | Dzierzbicki | 81/441 |
| 6,282,999 | B1 | 9/2001 | Hite et al. | |
| 6,598,498 | B1 * | 7/2003 | Pigford et al. | 81/53.2 |
| 7,024,972 | B2 | 4/2006 | Werner et al. | |
| 7,594,455 | B2 * | 9/2009 | Swanson et al. | 81/53.2 |
| 8,366,365 | B2 * | 2/2013 | Disantis et al. | 411/332 |
| 2004/0255727 | A1 | 12/2004 | Kovach | |
| 2005/0150331 | A1 * | 7/2005 | Horobec | 81/53.2 |
| 2005/0183548 | A1 * | 8/2005 | Horobec | 81/53.2 |
| 2006/0191379 | A1 * | 8/2006 | McCalley et al. | 81/53.2 |
| 2008/0181746 | A1 * | 7/2008 | Reiter | 411/177 |

OTHER PUBLICATIONS

Superior Tool Corp., 5-Piece Plumber's Extractor Kit, USAB2C Online Catalog, May 31, 2011.
Master Drain Extractor, Facebook.com, Jan. 2011.

* cited by examiner

SECT. A-A

DRAIN REMOVAL TOOL

PRIORITY CLAIM

This application claims priority from provisional patent application Ser. No. 61/539,095 filed on Sep. 26, 2011, the subject matter of which is incorporated herein by reference in its entirety.

TECHNICAL FIELD

The present application is directed to a tool for removing an existing drain from a tub, shower or sink fixture.

BACKGROUND

Removing a drain from a tub, shower or sink fixture can be difficult when the drain has significant deterioration due to age. In particular, when the crosshairs on the old drain are corroded and/or missing, the many available prior art drain removal tools may not be sufficient to remove the drain. When prior art tools fail to remove the drain, extreme measures are often taken, such as hammering or chiseling the drain to assist with removal. Such extreme measures increase the risk that the surface of the tub, shower or sink may be damaged or cracked in order to successfully remove the drain.

SUMMARY OF THE INVENTION

The present application is for a new and improved drain removal tool. The removal tool of this application may be of any iron, steel or equivalent metal material, conveniently manufactured from hex stock material. The tool includes a holding section and an engagement section. The holding section has a top hammer surface. The engagement section includes a bottom surface, and a central opening having a central axis which passes through the tool between the top hammer surface of the holding section and the bottom surface of the engagement section. The holding section is also provided with additional surface configurations for gripping the tool and applying torque during drain removal.

The engagement section of the removal tool is provided with ridges or pointed teeth, extending outwardly from the surface of the engagement section. The ridges or teeth are arranged in a helical pattern along the engagement section, with each helical tooth or serration being a left hand helical serration on a 15 degree pitch with respect to the central axis of the central opening. Each tooth has one flat face, which flat face is aligned along a radius extending outwardly from the central axis, and a ramped face. The teeth are spaced such that the distance between the flat face of each tooth is approximately 6 degrees, with the helical arrangement and pitch of the teeth resulting in an angled or knurled configuration to the engagement section, with the engagement portion of the tool at the top of the teeth having a larger external diameter than the external diameter of the bottom portion of the engagement section.

To use the drain removal tool, the tool is dropped or placed into the old drain to be removed. The top surface of the tool may be hammered, or simply pressed, such that the pointed teeth contact the drain. Next, a pipe wrench, locking plier, fixed wrench or other torque applying tool is mounted or engaged with the holding section, and a torque is applied to turn the tool counter clockwise. The more torque that is applied to the drain removal tool to the holding section, the more the teeth of the engagement section will bite, or engage into, the drain, enabling the drain to be removed. Slippage or displacement of the tool within the drain is minimized as a result of the teeth along the engagement section.

BRIEF DESCRIPTION OF THE DRAWINGS

The attached figures illustrate non-restrictive examples of the tool device of the present application. The figures include.

DETAILED DESCRIPTION

Figure 1:
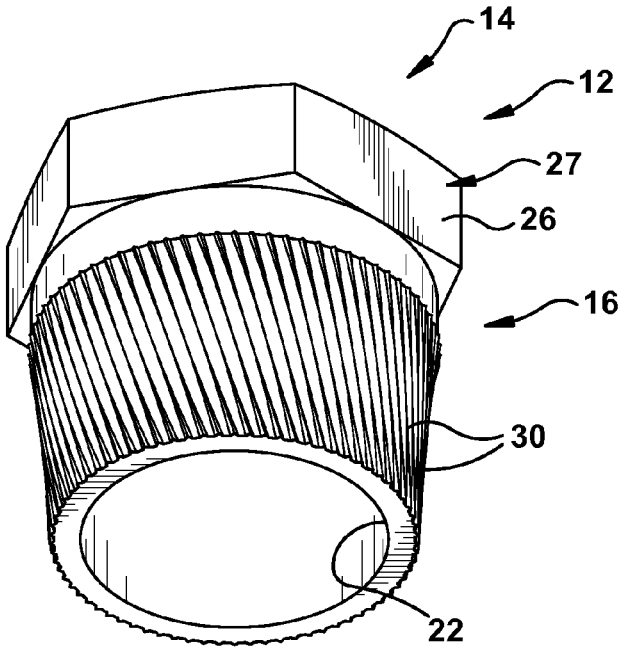
FIG. 1 is a perspective view of the drain removal tool of the present application.

As shown in FIG. 1, the present application provides a new and improved drain removal tool 12. The drain removal tool device is desirable when the crosshairs on your old sink, tub or shower fixture drain are corroded and/or missing and other prior art drain removal tools fail. The present tool 12 is able to remove stubborn drains which resist removal. There is no need to use a chisel and hammer to remove the drain, which risks surface damage or cracking of the fixture. The helical knurled aspect of the present device avoids a number of problems.

Figure 2:
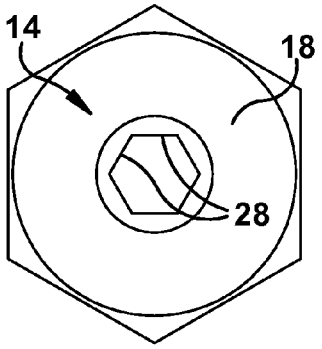
FIGS. 2 and 6 are top views of the design of FIG. 1.
Figure 3:
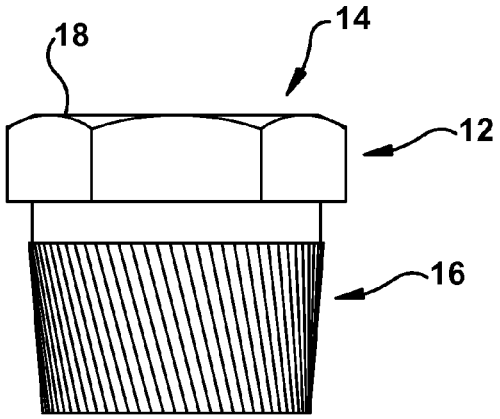
FIGS. 3 and 5 are side views of the design of FIG. 1.
Figure 4:
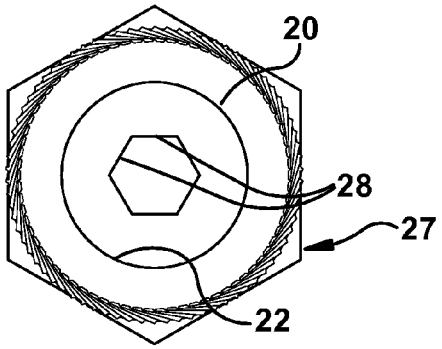
FIG. 4 is a bottom view of the tool of FIG. 1.
Figure 5:
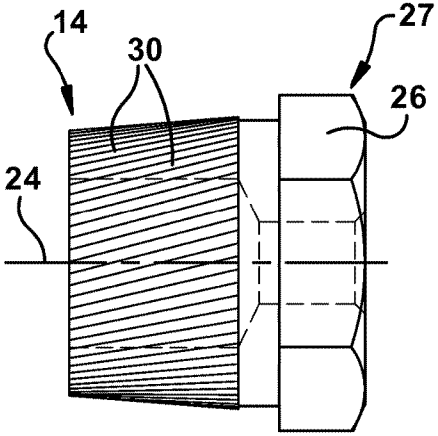
Figure 6:
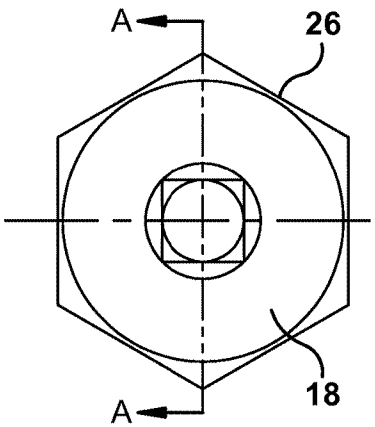
Figure 7:
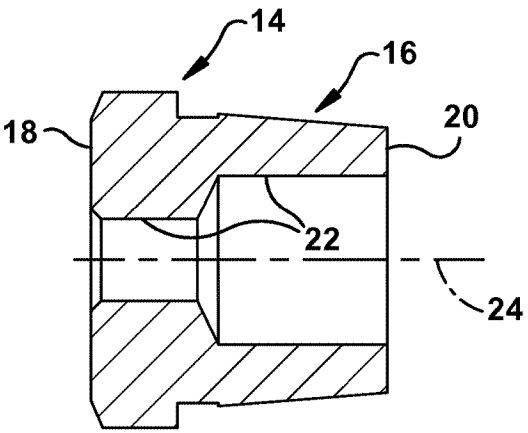
FIG. 7 is a cross-sectional side view of the tool, taken along the line A-A of FIG. 6.
Figure 9:
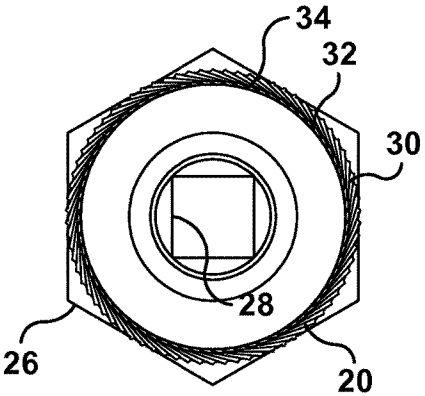
FIG. 9 is a partial conceptual view of the bottom of the tool of FIG. 5.

The drain removal tool 12 of this application may be of any iron, steel or equivalent metal material, but is preferably of hardened steel, such as 12L14 steel, with a black oxide finish. Further, as shown in FIGS. 2-4 and 6-10, the tool may be conveniently manufactured from hex stock material, for example, 1.75 inch hex stock in the illustrated embodiment. The tool 12 includes a holding section 14 and an engagement section 16. The holding section 14 has a top hammer surface 18. The engagement section 16 includes a bottom surface 20. A central opening 22 with a central axis 24 passes through the tool 12 between the top hammer surface 18 of the holding section 14 and the bottom surface 20 of the engagement section 16. The holding section 14 is also provided with numerous additional surfaces for gripping the tool and applying torque during drain removal. First, external surfaces 26 of the holding section 14 form a hex head 27, which is approximately 0.5 inches in height, for engagement by an adjustable wrench, pipe wrench or other gripping tool, such as ViseGrip® pliers. Second, within the holding section, along the central opening 22, internal surfaces 28 are provided for engagement by either an Allen® wrench or other adjustable socket wrench. In FIGS. 2-4, the internal surfaces 28 form a hex configuration for receiving a mating wrench. In FIGS. 6 and 9, the internal surfaces 28' form a square configuration receiving for a mating wrench, such as a ratchet wrench or extension. In these embodiments the central opening 22 is shown as extending through the entire tool 12 from the top hammer surface 18 to the bottom surface 20 of the engagement section 16. A central opening extending through the entire tool is optional. Alternative torque applying tools for use with the tool holding section are illustrated, for example, in FIGS. 10A to 10D.

Figure 8:
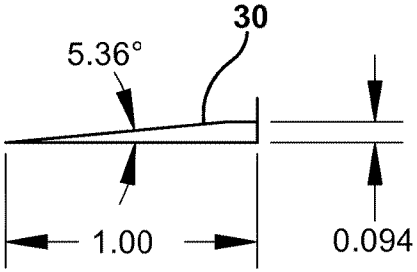
FIG. 8 is an enlarged view of a helical tooth of the tool of FIG. 5.
Figure 10B:
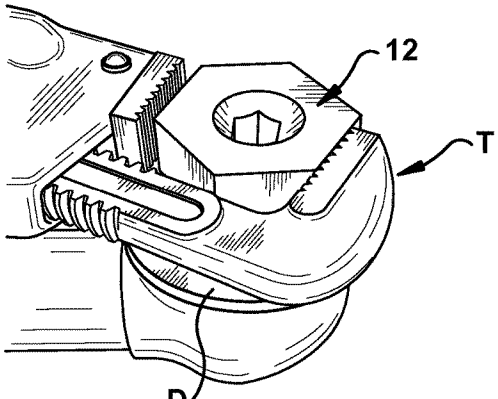
FIGS. 10A, 10B, 10C and 10D each illustrate an alternate method by which the drain removal tool may be used to remove a drain.
Figure 10D:
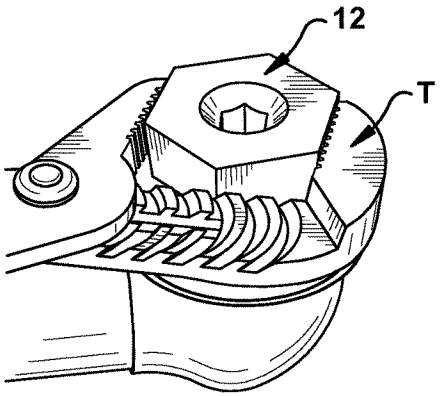
Figure 10:
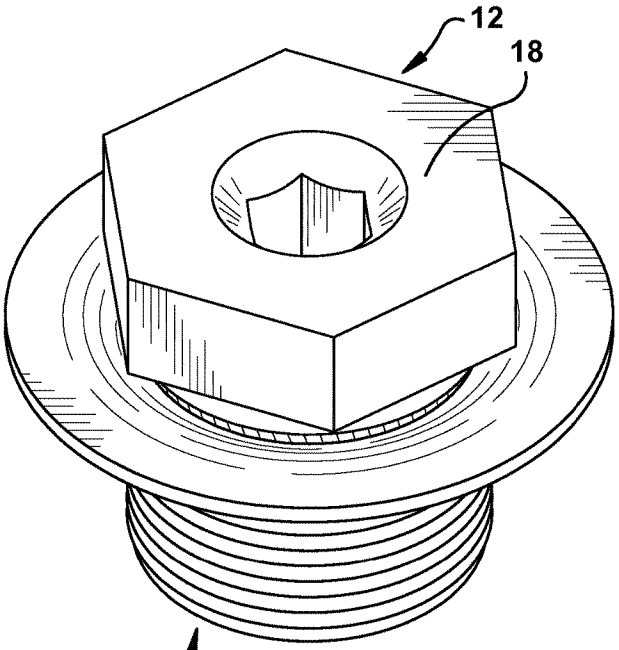
FIG. 10 illustrates the drain removal tool engaged within a drain which has been removed from the tub or sink.
Figure 10A:
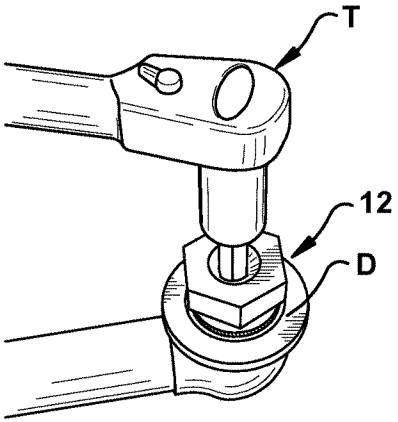
Figure 10C:
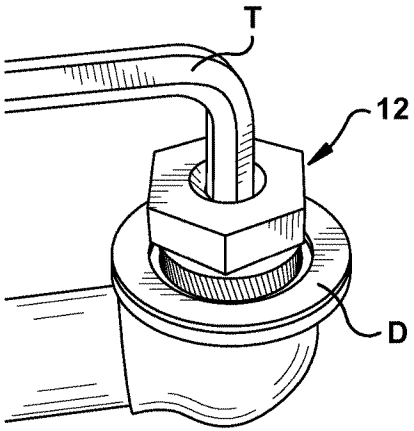

The engagement section 16 of the removal tool 12 is provided with ridges or pointed teeth 30, extending outwardly from the surface of engagement section. The portion of the engagement section 16 supporting the teeth 30 has a height of approximately 1 inch from the bottom surface 20 to the top of the teeth. The ridges or teeth 30 are arranged in a helical pattern along the engagement section 16, each helical tooth or serration being a left hand helical serration on a 15 degree pitch with respect to the central axis 24 of the central opening 22. As shown in FIG. 8, each tooth 30 begins at the bottom surface 20 of the engagement section 16, and ramps to a height of approximately 0.094 inches. In other words, the external diameter of the engagement section 16 adjacent the bottom surface 20 is approximately 1.562 inches, and the external diameter of the engagement section at its widest location at the top of the teeth 30 is approximately 1.75 inches. Each tooth has one flat face 32, which flat face 32 is aligned along a radius extending outwardly from the central axis 24, and a ramped face 34, which extends out of the engagement portion 16 at approximately 5.36 degrees with respect to the central axis. The teeth 30 are spaced such that the distance between each tooth flat face 32 is approximately 6 degrees. As shown, the helical arrangement and pitch of the teeth 30 results in an angled or knurled configuration to the engagement section 16, with the portion of the tool 12 at the top of the teeth 30 having a larger external diameter than the external diameter adjacent the bottom surface of the engagement section.

To use the drain removal tool 12, the tool is dropped or placed into the old drain D to be removed. The top hammer surface 18 of the tool may be hammered, or simply pressed, such that the pointed teeth 30 contact the drain D. Next, a pipe wrench, locking pliers, an Allen wrench or other torque applying tool T is mounted or engaged with the holding section 14, and torque is applied to turn the tool counter clockwise. The more torque that is applied to the drain removal tool, the more the teeth 30 of the engagement section 16 will bite, or engage into, the drain, enabling the drain to be turned and removed. Slippage of the tool 12 within the drain D is minimized due to the engaged teeth 30 along the engagement section 16.

While the preferred embodiments of the drain removal tool 12 have been illustrated and described, it should be understood that variations will become apparent to those skilled in the art. Accordingly, the invention is not to be limited to the specific embodiments illustrated and described herein, but rather the true scope and spirit of the invention are to be determined by reference to the appended claims.

I claim:

1. A drain removal tool having a central opening aligned along a central tool axis and extending through the entire tool, a non-threaded holding section for applying torque to the tool, the holding section including a flat sided hex head configuration and a flat top hammer surface, and a work piece or drain engagement section including sharp elongate teeth extending from a continuous, non-segmented external surface of the engagement section of the tool for engagement with the drain to be removed to a bottom surface of the engagement section, and the central opening in the engagement section has a substantially cylindrical opening, with a larger diameter than the central opening having, a polygonal cross sectional configuration in the holding section.

2. The drain removal tool of claim 1, wherein the sharp teeth are elongate ridges in a helical pattern on the external surface of the engagement section of the tool.

3. The drain removal tool of claim 2, wherein each elongate ridge has one flat face, which flat face is aligned along a radius extending outwardly from the central tool axis, and a ramped face.

4. The drain removal tool of claim 3, wherein the teeth are spaced such that the distance between each flat face is approximately 6 degrees.

5. The drain removal tool of claim 2, wherein the each helical tooth is a left hand helical serration on a 15 degree pitch with respect to the central axis of the central opening.

6. The drain removal tool of claim 2, wherein the central opening in the holding section is a hex configuration.

7. The drain removal tool of claim 2, wherein the central opening in the holding section is a square configuration.

8. A drain removal tool having a central opening aligned along a central tool axis and extending through the entire tool, a holding section having a flat sided hex head configuration for applying torque to the tool, and a top hammer surface, and a substantially cylindrical, non-segmented drain engagement section including elongate sharp ridges extending in a helical pattern from an external surface of the engagement section from the tool for engagement with the drain to be removed to a bottom surface of the engagement section, the central opening, having a substantially cylindrical opening in the engagement section, a polygonal cross sectional configuration in the holding section, and the central opening in the holding section has a smaller diameter than the substantially cylindrical opening in the engagement section.

9. The drain removal tool of claim 8, wherein each elongate sharp ridge has one flat face, which flat face is aligned along a radius extending outwardly from the central tool axis, and a ramped face.

10. The drain removal tool of claim 9, wherein the ridges are spaced such that the distance between each flat face is approximately 6 degrees.

11. The drain removal tool of claim 10, wherein the each helical ridge is a left hand helical serration on a 15 degree pitch with respect to the central axis of the central opening.

12. The drain removal tool of claim 11, wherein the central opening in the holding section is a hex configuration.

13. A drain removal tool having a central opening aligned along a central tool axis and extending through the entire tool, a holding section having a top hammer surface and a hex head for applying torque to the tool, and a substantially cylindrical, non-segmented work piece engagement section including elongate sharp ridges extending in a helical pattern from an external surface of the engagement section from the tool for engagement with the drain to be removed to a bottom surface of the engagement section, wherein the diameter of a polygonal cross sectional configuration of the central opening in the holding section is smaller than the diameter of a substantially cylindrical opening of the central opening in the engagement section, and each elongate sharp ridge has one flat face, which flat face is aligned along a radius extending outwardly from the central tool axis, and a ramped face.

14. The drain removal tool of claim 13, wherein the ridges are spaced such that the distance between each flat face is approximately 6 degrees.

15. The drain removal tool of claim 14, wherein the each helical ridge is a left hand helical serration on a 15 degree pitch with respect to the central axis of the central opening.

16. The drain removal tool of claim 15, wherein the holding section includes a flat sided, external hex head configuration.

17. The drain removal tool of claim 16, wherein the central opening in the holding section is a hex configuration.

* * * * *